US006181896B1

(12) United States Patent
Zirilli et al.

(10) Patent No.: US 6,181,896 B1
(45) Date of Patent: Jan. 30, 2001

(54) DEVELOPMENT HOUSING HAVING IMPROVED TONER EMISSION CONTROL

(75) Inventors: Francisco Zirilli, Penfield; James M. Chappell, Pittsford; William N. Vogt, Rochester, all of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/314,185

(22) Filed: May 19, 1999

(51) Int. Cl.[7] ..... G03G 15/08

(52) U.S. Cl. ..... 399/98; 399/266

(58) Field of Search ..... 399/98, 99, 264, 399/265, 266, 290

(56) References Cited

U.S. PATENT DOCUMENTS 5,032,872 * 7/1991 Folkins et al. ..... 399/266
5,862,440 * 1/1999 Christy et al. ..... 399/99
6,067,428 * 5/2000 Zirilli et al. ..... 399/98 X

FOREIGN PATENT DOCUMENTS 6-027801 * 2/1994 (JP) .

* cited by examiner

*Primary Examiner*—Sophia S. Chen
(74) *Attorney, Agent, or Firm*—Lloyd F. Bean, II

(57) ABSTRACT

An electrophotographic printing machine of the type in which an electrostatic latent image recorded on a charge retentive surface is developed with toner particles to form a visible image thereof. A Hybrid Scavengeless Development (HSD) developer housing designed to control toner emission by employing two internal capture[JMC16], external exhaust manifolds. The location of the two manifolds are placed above and below the upper and lower donor rolls respectively. The manifolds are mounted in position to improve emissions control as well as reductions in the flow needed to accomplish the task. The upper and lower manifolds are able to control the loose toner emitted by the housing and lower powder cloud, they cannot collect the toner released by the upper powder cloud. To prevent toner accumulation in the middle regions of the wire module, a manifold is incorporated as an integral part of the wire module frame. Finally, toner released in the region between the two donor rolls near the magnetic roll surface may be controlled by inserting a baffle.

3 Claims, 4 Drawing Sheets

DEVELOPMENT HOUSING HAVING IMPROVED TONER EMISSION CONTROL

BACKGROUND OF THE INVENTION

This invention relates generally to the development of electrostatic images, and more particularly concerns a developer housing design which allows a steady flow of air into the developer housing and prevents toner emission therefrom.

Hereby incorporated by reference, is an inventor-related U.S. patent application Ser. No. 6,067,428 by the same assignee, filed on the same date as this application, and entitled "DEVELOPMENT HOUSING HAVING IMPROVED TONER EMISSION CONTROL".

The invention can be used in the art of electrophotographic printing. Generally, the process of electrophotographic printing includes sensitizing a photoconductive surface by charging it to a substantially uniform potential. The charge is selectively dissipated in accordance with a pattern of activating radiation corresponding to a desired image. The selective dissipation of the charge leaves a latent charge pattern that is developed by bringing a developer material into contact therewith. This process forms a toner powder image on the photoconductive surface which is subsequently transferred to a copy sheet. Finally, the powder image is heated to permanently affix it to the copy sheet in image configuration.

Two component and single component developer materials are commonly used. A typical two component developer material comprises magnetic carrier granules having toner particles adhering triboelectrically thereto. A single component developer material typically comprises toner particles having an electrostatic charge so that they will be attracted to, and adhere to, the latent image on the photoconductive surface.

There are various known development systems for bringing toner particles to a latent image on a photoconductive surface. Single component development systems use a donor roll for transporting charged toner to the development nip defined by the donor roll and the photoconductive surface. The toner is developed on the latent image recorded on the photoconductive surface by a combination of mechanical scavengeless development. A scavengeless development system uses a donor roll with a plurality of electrode wires closely spaced therefrom in the development zone. An AC voltage is applied to the wires detaching the toner from the donor roll and forming a toner powder cloud in the development zone. The electrostatic fields generated by the latent image attract toner from the toner cloud to develop the latent image. In another type of scavengeless system, a magnetic developer roil attracts developer from a reservoir. The developer includes carrier and toner. The toner is attracted from the carrier to a donor roll. The donor roll then carries the toner into proximity with the latent image.

One method of controlling toner emissions from developer housings in xerographic equipment is to relieve any positive pressure generated in the housing. Moving components such as the mag brush rolls and the mixing augers can pump air into the housing, causing slight positive pressures. These positive pressures can result in air flow out of the housing via low impedance leakage paths. This air escaping from the housing contains entrained toner and is a major potential source of dirt within the xerographic system. A common approach to relieving this pressure is through the use of a "sump sucker". In it's simplest form a sump sucker is a simple port into the air space above the developer material in the housing. This lowers the pressure in the housing below atmospheric pressure, therefore air flows into, rather than out of any low air impedance leakage paths within the housing. This toner laden air is drawn through a sump assembly. A shortcoming of these systems is that a considerable amount of toner emission contamination is present in the areas around the donor rolls in the developer housing. Additionally, excessive toner accumulation occurs on overhand trim features, and internal filtration is required to avoid excessive toner waste rates. Said filtration being subject to frequent cleaning cycling to prevent clogging.

As xerographic printer process speeds increase, a corresponding increase of development roller angular velocities is required to maintain adequate developability or donor reload. The problem with escaping toner has become more acute and under these conditions toner emissions have increased and are considered a serious problem.

BRIEF SUMMARY OF THE INVENTION

In accordance with one object of the present invention, there is provided improved developer housing design which allows a steady flow of air into a development housing and prevents toner emission therefrom. There is provided an electrophotographic printing machine of the type in which an electrostatic latent image recorded on a charge retentive surface is developed with toner particles to form a visible image thereof, comprising; a housing having a supply of toner and developer therein; a first donor roll for transporting toner from said housing to the development zone; a second donor roll, adjacent to said first donor member, for transporting toner from said housing to the development zone; a first manifold, adjacent to said first donor roll, having an air stream for removing toner emission; and a second manifold, adjacent to said second roll having an air stream for removing toner emission near a vicinity thereof.

DETAILED DESCRIPTION OF THE PREFERRED EMBODIMENT OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Inasmuch as the art of electrophotographic printing is well known, the various processing stations employed in the FIG. 1 printing machine will be shown hereinafter schematically and their operation described briefly with reference thereto.

Figure 1:
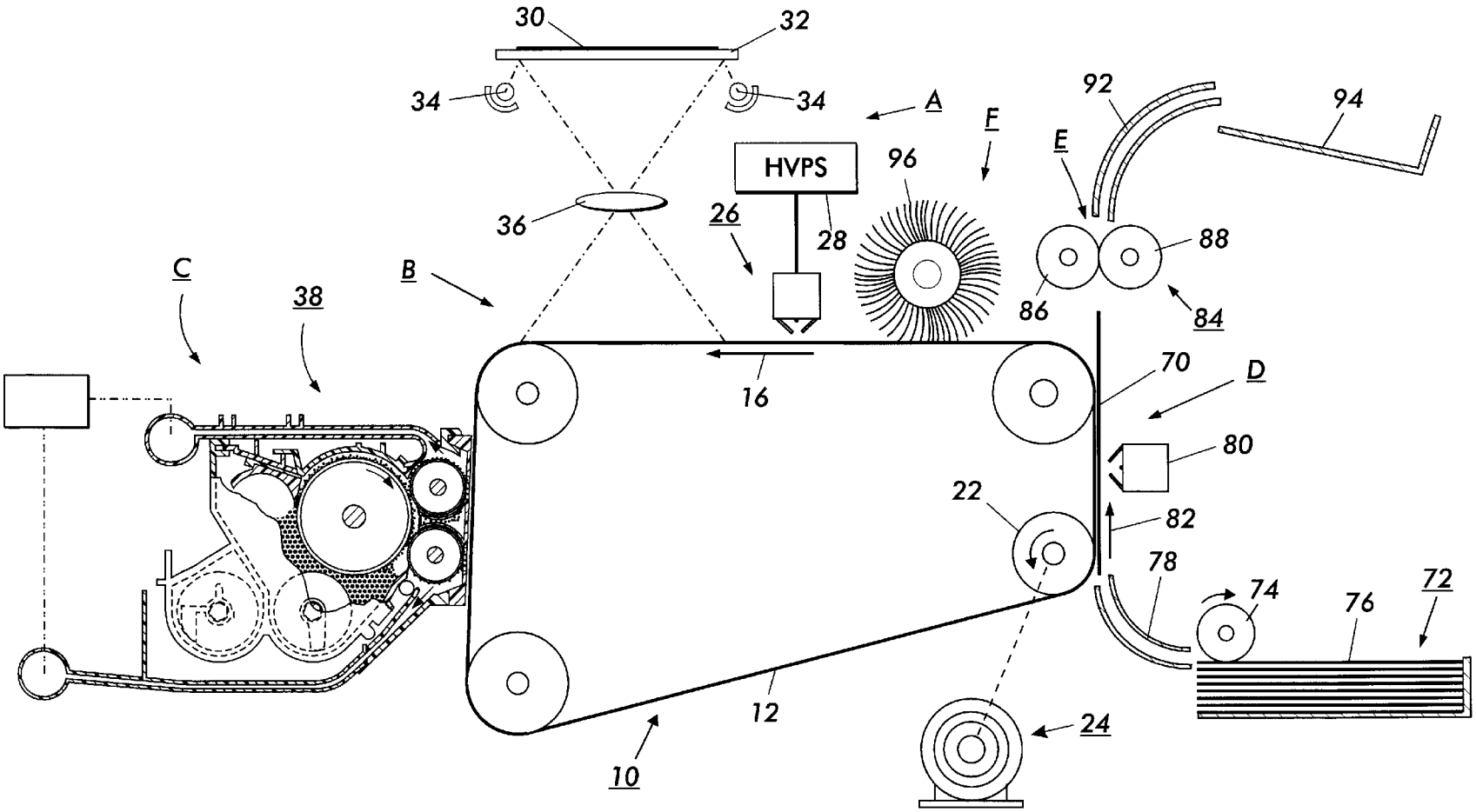
FIG. 1 is a schematic elevational view of an illustrative electrophotographic printing machine incorporating developer unit having the features of the present invention therein.

Referring initially to FIG. 1, there is shown an illustrative electrophotographic printing machine incorporating the development apparatus of the present invention therein. The electrophotographic printing machine employs a belt 10 having a photoconductive surface 12 deposited on a conductive substrate. Preferably, photoconductive surface 12 is made from selenium alloy. The conductive substrate is made preferably from an aluminum alloy that is electrically grounded. One skilled in the art will appreciate that any suitable photoconductive belt may be used. Belt 10 moves in the direction of arrow 16 to advance successive portions of photoconductive surface 12 sequentially through the various processing stations disposed of throughout the path of movement thereof. Motor 24 rotates belt 10 in the direction of arrow 16. Roller 22 is coupled to motor 24 by suitable means, such as a drive belt.

Initially, a portion of belt 10 passes through charging station A. At charging station A, a corona generating device, indicated generally by the reference numeral 26 charges photoconductive surface 12 to a relatively high, substantially uniform potential. High voltage power supply 28 is coupled to corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses this light image onto the charged portion of photoconductive surface 12 to selectively dissipate the charge thereon. This records an electrostatic latent image on photoconductive surface 12 that corresponds to the informational areas contained within original document 30.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor rolls 40 and 41 and electrode wires 42. Electrode wires 42 are electrically biased relative to donor rolls 40 and 41 to detach toner therefrom so as to form a toner powder cloud 43 in the gap between the donor rolls and the photoconductive surface. The latent image attracts toner particles from the toner powder cloud 43 forming a toner powder image thereon. Donor rolls 40 and 41 are mounted, at least partially, in the chamber of the developer housing. The chamber in the developer housing stores a supply of developer material. In one embodiment the developer material is a single component development material of toner particles, whereas in another, the developer material includes at least toner and carrier.

With continued reference to FIG. 1, after the electrostatic latent image is developed, belt 10 advances the toner powder image to transfer station D. A copy sheet 70 is advanced to transfer station D by sheet feeding apparatus 72. Preferably, sheet feeding apparatus 72 includes a feed roll 74 contacting the uppermost sheet of stack 76 into chute 78. Chute 78 directs the advancing sheet of support material into contact with photoconductive surface 12 of belt 10 in a timed sequence so that the toner powder image developed thereon contacts the advancing sheet at transfer station D. Transfer station D includes a corona generating device 80 which sprays ions onto the back side of sheet 70. This attracts the toner powder image from photoconductive surface 12 to sheet 70. After transfer, sheet 70 continues to move in the direction of arrow 82 onto a conveyor (not shown) that advances sheet 70 to fusing station E.

Fusing station E includes a fuser assembly, indicated generally by the reference numeral 84, which permanently affixes the transferred powder image to sheet 70. Fuser assembly 84 includes a heated fuser roller 86 and a back-up roller 88. Sheet 70 passes between fuser roller 86 and back-up roller 88 with the toner powder image contacting fuser roller 86. In this manner, the toner powder image is permanently affixed to sheet 70. After fusing, sheet 70 advances through chute 92 to catch tray 94 for subsequent removal from the printing machine by the operator.

After the copy sheet is separated from photoconductive surface 12 of belt 10, the residual toner particles adhering to photoconductive surface 12 are removed therefrom at cleaning station F. Cleaning station F includes a rotatably mounted fibrous brush 96 in contact with photoconductive surface 12. The particles are cleaned from photoconductive surface 12 by the rotation of brush 96 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the development apparatus of the present invention therein.

Figure 2:
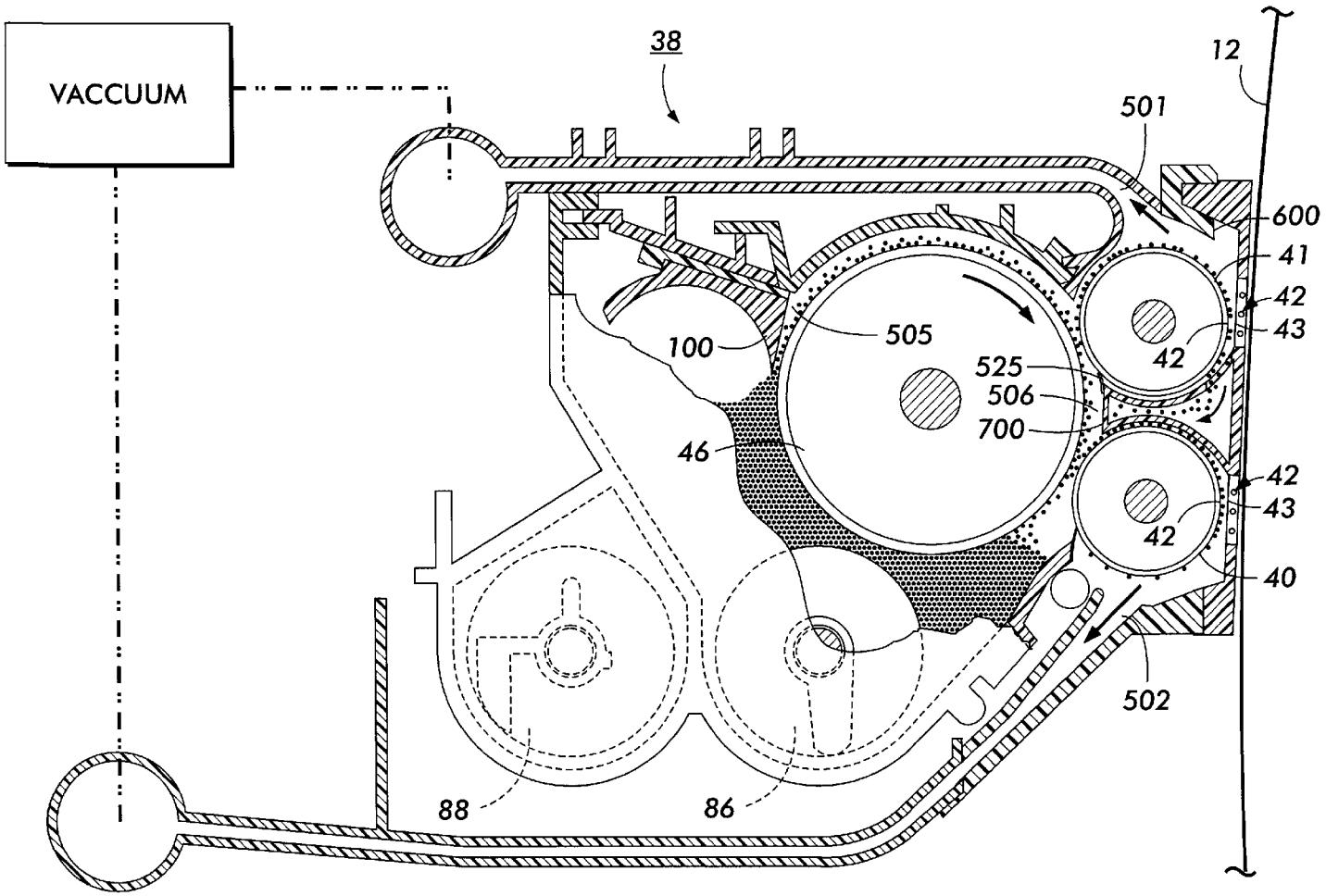
FIG. 2 is a schematic elevational view showing one embodiment of the developer unit used in the FIG. 1 printing machine.
Figure 3:
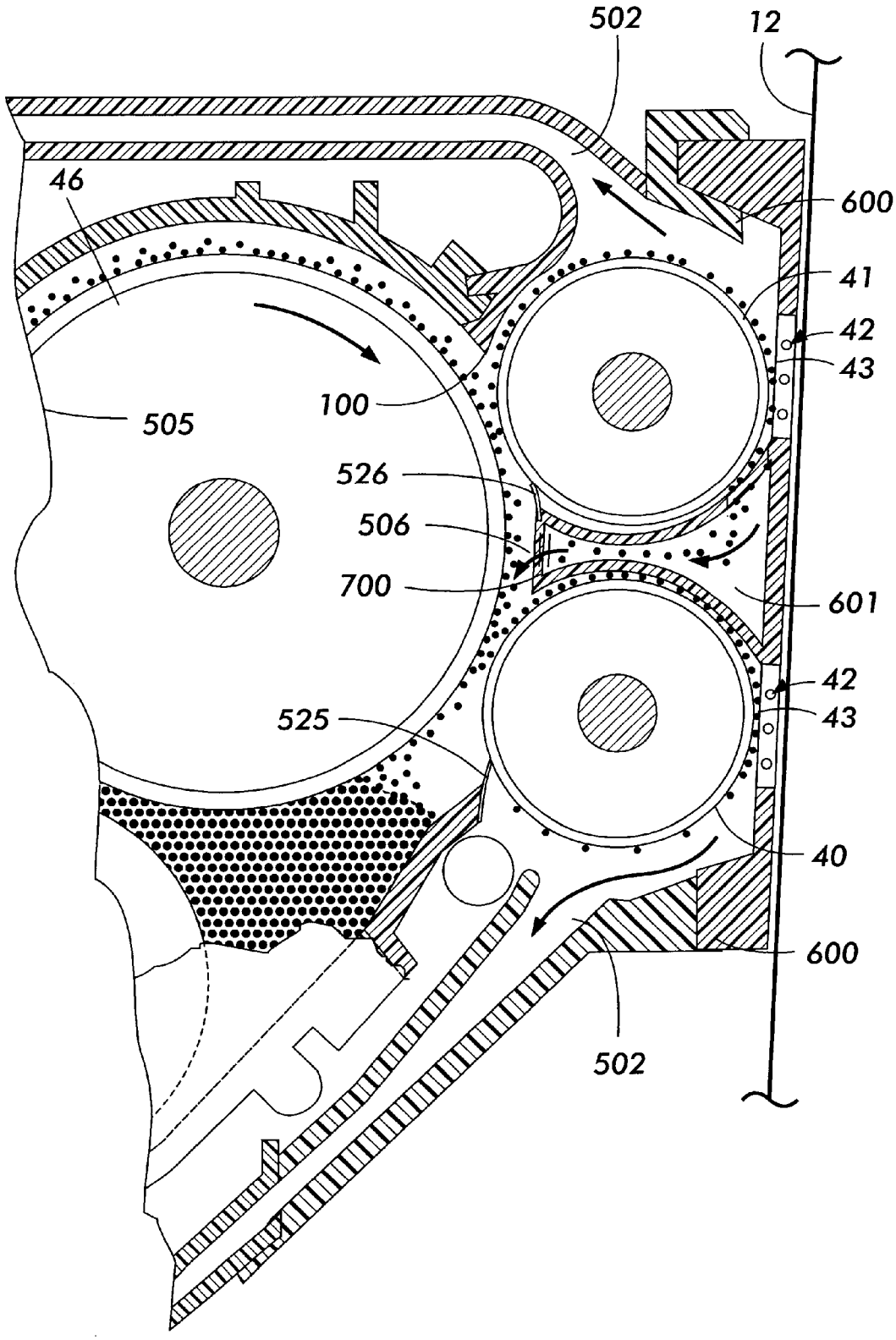
FIG. 3 is an enlarged illustration of the present invention.
Figure 4:
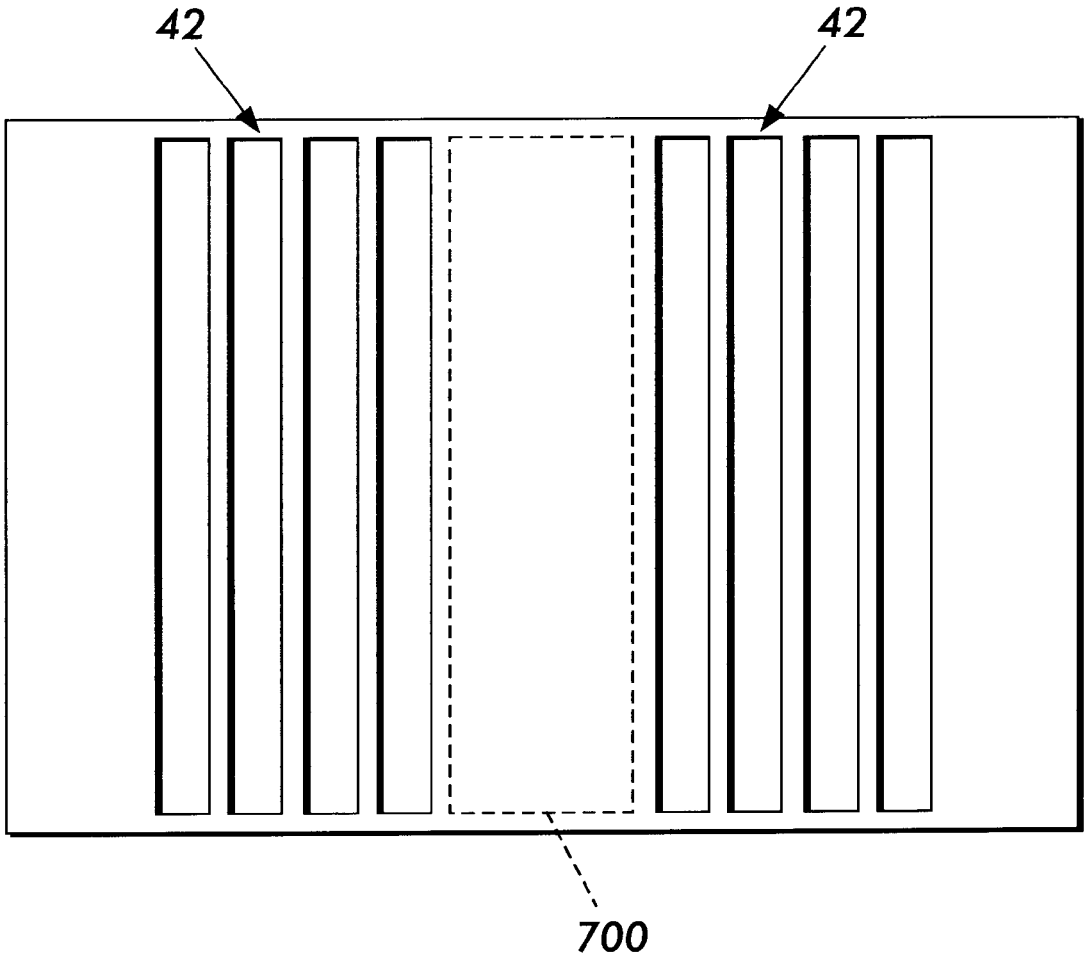
FIG. 4 is a top view of the wire module employed with the present invention.

Referring now to FIG. 2, there is shown one embodiment of the present invention in greater detail. The development system 38 includes donor rolls 40 and 41, electrode wires 42, and magnetic metering roll 46. Roll 46 supplies charged toner to donor rolls 40 and 41. Donor rolls 40 and 41 can be rotated in either the 'with' or 'against' direction relative to the direction of motion of belt 10. The donor roll is shown rotating in the direction of arrow. Augers 88 and 86 mix developer material, which is supplied to magnetic roll 46.

The developer apparatus 38 further has electrode wires 42 located in the space between photoconductive surface 12 and donor rolls 40 and 41. The electrode wires 42 include one or more thin metallic wires which are lightly positioned against the donor rolls 40 and 41. The distance between the wires 42 and the donor rolls is approximately the thickness of the toner layer on the donor rolls. The extremities of the wires are supported by rectangular frame modules (not shown) located around the periphery of each donor roll.

An electrical bias is applied to the electrode wires by a power source (not shown). The bias establishes an electrostatic field between the wires 42 and the donor rolls, which is effective in detaching toner from the surface of the donor rolls and forming a toner cloud 43 about the wires 42. The height of the cloud being such as not to contact with the photoconductive surface 12.

A DC bias supply (not shown) establishes an electrostatic field between the photoconductive surface 12 and donor rolls 40 and 41 for attracting the detached toner particles from the cloud surrounding the wires 42 to the latent image on the photoconductive surface 12. A DC bias supply (not shown) establishes an electrostatic field between magnetic roll 46 and donor rolls which causes toner particles to be attracted from the magnetic roll to the donor roll. A metering blade portion 100 can be positioned closely adjacent to magnetic roll 46 to maintain the compressed pile height of the developer material on magnetic roll 46 at the desired level Magnetic roll 46 includes a non-magnetic tubular member or sleeve made preferably from aluminum and having the exterior circumferential surface thereof roughened. An elongated multiple magnet is positioned interiorly of and spaced from the tubular member. Elongated magnet is mounted on bearings and coupled to the motor. The sleeve may also be mounted on suitable bearings and coupled to the motor. Toner particles are attracted from the carrier granules on the magnetic roll to the donor roll. A zone of minimal magnetic field allows denuded carrier granules and extraneous developer material to fall away from the surface of the sleeve.

As successive electrostatic latent images are developed, the toner particles within the developer material are depleted. Augers are mounted rotatably to mix fresh toner particles with the remaining developer material so that the resultant developer material therein is substantially uniform with the concentration of toner particles being optimized.

Applicants have performed extensive numerical simulation research for toner particle trajectories for the nominal 7-micron diameter toner particles with the manifolds 501 and 502 operating at 10 cubic feet per minute (CFM) each. The particles are released from two locations; the trim region 505 and the region 506 between the two donor rolls. As a result of extensive research on the toner flow patterns in the developer housing studied; it has been found that the bulk of the contamination escapes from region 506 with several key surfaces exposed to the contamination. Predominately, the surfaces of the wire module support frames 600 and 601 which form the walls of the air channels around the donor rolls and photoconductor. Applicants have found that location of the upper and lower manifolds 501 and 502 is a primary factor in reducing toner contamination. Applicants have found that positioning upper and lower manifolds 501 and 502 with the vacuum inlet plenum centerlines facing donor rolls 40 and 41 at approximately 11 o'clock and 7 o'clock respectively, results in increased collection performance at reduced bulk air flows. The channel widths formed by the surfaces of the plenum entrance flanges relative to each of the respective donor rolls and the photoconductor surfaces, being such that the velocity of the contaminated air not exceed the velocity required to maintain the mean particle trajectory near the centerline of the plenum entrances. The attitude of the plenum openings and the cross sectional area reduction in the direction of flow from plenum opening to transport duct, being such that the mean particle trajectory is maintained near the centerline of the ducting. This results in significant reduction of toner accumulation inside the ducts, caused by particle impaction with duct walls. The elimination of the gap in the center portion 506 of the wire modules 600 and 601 is also a factor in reducing toner contamination. Numerical and experimental results indicate that toner particles leaving this region deposit on the frames of the wire modules 600 and 601 in this area. To prevent toner accumulation a manifold is incorporated as an integral part of the wire module frame. Particle trajectory models and experimental results reveal that the outer surfaces of the wire modules 600 and 601 are free of toner contamination. Applicants have found that contoured wire module support frames provide uniform channel cross section for uniform (non-decelerating) velocity profiles; and constant cross sectional channels with non-decelerating flows improve toner transport and eliminate toner accumulation. Particle trajectories, with the proposed manifold locations, were computed with 10-CFM per manifold, experimental results show that excellent results are obtained at 1-CFM per manifold. Experimental results show that operating the manifolds at 10-CFM each, excessive toner is pulled from the developer sump, increasing the toner waste rate.

To eliminate toner deposition on trim bar 100, the top cover is contoured to the magnetic brush. This constant spacing also provides a high impedance path to minimize the toner/air mixture to be removed from the back of the housing by the upper manifold. The upper manifold plenum entrance off of the top donor roll surface is also contoured to minimize toner accumulation on the walls due to the sudden turn of the flow and the toner particle trajectory. Finally, urethane lip seals 525 and 526 are employed to reduce toner and developer output from areas applied. The seals also provide a high impedance path to mix the toner/air mixture to be removed from the back of the developer housing. A baffle 700 is located in the space between donor rolls 40 and 41. The baffle 700 has the contour of rolls 40 and 41 on respective sides thereof. It has been observed that the presence of this baffle 700 drastically reduces the toner and developer emissions carried out by the lower donor roll 40.

In recapitulation there has been provided an HSD developer housing designed to control toner emission by employing two internal capture, external exhaust manifolds. The location of the two manifold plenum entrances are located above and below the upper and lower donor rolls respectively. Numerical predictions of the flow patterns as well as experimental results show improved emissions control as well as reductions in the flow needed. to accomplish the task. The region between the two donor rolls provides a particular challenge. Even though the upper and lower manifolds are able to control the loose toner emitted by the housing and lower powder cloud, they cannot completely collect the toner released by the upper powder cloud. To prevent toner accumulation in the middle regions of the wire module, it is proposed that a manifold be incorporated as an integral part of the wire module frame. Finally, toner released in the region between the two donor rolls near the mag roll surface may be controlled by inserting a baffle.

It is, therefore, apparent that there has been provided in accordance with the present invention that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An electrophotographic printing machine of the type in which an electrostatic latent image recorded on a charge retentive surface is developed with toner particles to form a visible image thereof, comprising:

a housing having a supply of toner and developer therein;

a first donor roll for transporting toner from said housing to a development zone;

a second donor roll, adjacent to said first donor member, for transporting toner from said housing to the development zone;

a baffle between said first donor roll and said second donor roll;

a first manifold , adjacent to said first donor roll, having an air stream for removing toner emission; and a second manifold, adjacent to said second roll, having an air stream for removing toner emission near a vicinity thereof.

2. An electrophotographic printing machine of the type in which an electrostatic latent image recorded on a charge retentive surface is developed with toner particles to form a visible image thereof, comprising:

a housing having a supply of toner and developer therein;

a first donor roll for transporting toner from said housing to a development zone;

a second donor roll, adjacent to said first donor member, for transporting toner from said housing to the development zone;

a first manifold, adjacent to said first donor roll, having an air stream for removing toner emission; and a second manifold, adjacent to said second roll, having an air stream for removing toner emission near a vicinity thereof and wherein said first manifold is disposed with a vacuum inlet plenum centerline facing at approximately 11 o'clock in relation to said first donor roll.

3. An electrophotographic printing machine of the type in which an electrostatic latent image recorded on a charge retentive surface is developed with toner particles to form a visible image thereof, comprising:

a housing having a supply of toner and developer therein;

a first donor roll for transporting toner from said housing to a development zone;

a second donor roll, adjacent to said first donor member, for transporting toner from said housing to the development zone;

a first manifold, adjacent to said first donor roll, having an air stream for removing toner emission; and a second manifold, adjacent to said second roll, having an air stream for removing toner emission near a vicinity thereof and wherein said second manifold is disposed with a vacuum inlet plenum centerline facing at approximately 7 o'clock in relation to said second donor roll.

* * * * *